US007641051B2

(12) United States Patent
Ford et al.

(10) Patent No.: US 7,641,051 B2
(45) Date of Patent: Jan. 5, 2010

(54) PACKAGE FOR SELLING A PRODUCT WITH A GIFT ITEM AND FOR CONVERSION INTO A KEEPSAKE BOX

(75) Inventors: Jonathan Ford, Melrose Park, PA (US); Allan L. Ford, Melrose Park, PA (US)

(73) Assignee: Reborn Products Co., Inc., Bensalem, PA (US)

( * ) Notice: Subject to any disclaimer, the term of this patent is extended or adjusted under 35 U.S.C. 154(b) by 486 days.

(21) Appl. No.: 11/531,128

(22) Filed: Sep. 12, 2006

(65) Prior Publication Data

US 2008/0060957 A1 Mar. 13, 2008

(51) Int. Cl.
*B65D 1/22* (2006.01)
*B65D 5/50* (2006.01)
*B65D 85/42* (2006.01)

(52) U.S. Cl. ..... 206/747; 206/757; 206/418

(58) Field of Classification Search ..... 206/730, 206/732, 733, 734, 736, 779, 756, 759, 216, 206/232, 234, 472, 473, 579, 818, 747, 757; 53/139.4, 416; 220/230; 229/116.5, 120.01, 229/146

See application file for complete search history.

(56) References Cited

U.S. PATENT DOCUMENTS

| | | | | | |
|---|---|---|---|---|---|
| 78,715 | A * | 6/1868 | Armour | 229/120.03 |
| 714,988 | A * | 12/1902 | Wolf | 206/6.1 |
| 1,016,148 | A * | 1/1912 | Heinicke | 206/747 |
| 1,167,847 | A * | 1/1916 | Schoettle | 206/747 |
| 1,735,191 | A * | 11/1929 | Weisenberg | 229/116.1 |
| 2,126,407 | A * | 8/1938 | Payne et al. | 206/750 |
| 2,141,743 | A * | 12/1938 | Ethridge | 206/750 |
| 3,357,543 | A * | 12/1967 | Taggart | 206/747 |
| 3,807,537 | A * | 4/1974 | O'Reilly | 190/121 |
| 4,043,450 | A * | 8/1977 | Rielly | 206/761 |
| 4,256,223 | A * | 3/1981 | Pawlowski | 206/749 |
| 5,135,012 | A * | 8/1992 | Kamen et al. | 132/294 |
| 5,497,876 | A * | 3/1996 | Fleming | 206/232 |
| 5,738,214 | A * | 4/1998 | Wyss | 206/373 |
| 5,772,039 | A | 6/1998 | Orr et al. | |
| 6,053,326 | A | 4/2000 | Ford | |
| 6,173,833 | B1 * | 1/2001 | Strehlow | 206/216 |
| 6,398,026 | B1 * | 6/2002 | Parsons | 206/349 |
| 6,601,757 | B2 * | 8/2003 | Bowman | 229/116.5 |
| 6,626,291 | B2 * | 9/2003 | Pozzoli | 206/308.1 |

(Continued)

*Primary Examiner*—Stephen Garbe
*Assistant Examiner*—Dene Quest
(74) *Attorney, Agent, or Firm*—Caesar, Rivise, Bernstein, Cohen & Pokotilow, Ltd.

(57) ABSTRACT

A convertible display package and a wallet arranged to be hung from a support. The package includes a tray and a housing. The tray has a base wall, a peripheral side wall, an open top and a hollow interior. The wallet is located within the tray's interior. The housing is similarly constructed, except that its side wall includes a gap. The tray is arranged to be located within the housing, with its sidewall adjacent the housing's sidewall and with its open top within the housing's open top so that the wallet is visible. The tray is arranged to be slid out of the housing through the gap. A pair of magnets are provided for releasably holding the tray within the housing. The housing can be reversibly disposed with respect to the tray to form a lid with the base wall of the housing closing the open top of the tray.

9 Claims, 4 Drawing Sheets

U.S. PATENT DOCUMENTS 6,776,281 B2 * 8/2004 Ovadia ..... 206/232
6,823,988 B2 * 11/2004 Ryan et al. ..... 206/216
7,213,703 B2 * 5/2007 Begim ..... 206/232
7,331,461 B2 * 2/2008 MacKinnon ..... 206/553
2005/0194384 A1 * 9/2005 Petit ..... 220/230
2007/0193909 A1 * 8/2007 Chin et al. ..... 206/457

* cited by examiner

PACKAGE FOR SELLING A PRODUCT WITH A GIFT ITEM AND FOR CONVERSION INTO A KEEPSAKE BOX

BACKGROUND OF THE INVENTION

1. Field of Invention

This invention relates to packages for merchandising items and, more particularly, to a convertible package for holding an item to be sold and which package can be converted to be used thereafter as a keepsake box for small personal items, e.g., jewelry.

2. Description of Related Art

The merchandising of wallets, billfolds and the like is commonly effected by displaying those items in a box or some other package on a display rack or suspended from horizontally projecting members, e.g., prongs or hooks. For example, in U.S. Pat. No. 5,772,039 (Orr et al.) there is disclosed a packaging system for displaying an article, such as a wallet, in a manner such that it is readily accessible to shoppers, but are relatively difficult to shoplift. The packaging system comprises three main elements: a box, a box insert, and an attachment mechanism which secures the wallet to the box insert. The box insert is then adhesively attached to the box.

In U.S. Pat. No. 6,053,326 (Ford), which is assigned to the same assignee as the subject invention and whose disclosure is incorporated by reference herein, there is disclosed a packaging system for a wallet or billfold to enable it to be opened and examined, while deterring its removal from the packaging system. The packaging system basically comprises a box and a band member formed of a tear resistant material, e.g., a flat strip of plastic, which extends through a portion of the wallet and is secured to the box. A lid is provided to cover the box. A flanged insert member may also be provided in the interior of the box to serve as a means for carrying visible indicia, e.g., the model designation of the wallet or billfold, a trademark, pricing information, etc.

In our copending U.S. patent application Ser. No. 11/172,565, filed on Jun. 27, 2005, entitled Convertible Package for Merchandising a Wallet and for Forming a Personal Item Caddy or Valet, whose disclosure is incorporated by reference herein, there is disclosed and claimed a display package for an article, e.g., a wallet. The package is arranged to be hung from a support structure, e.g., a prong of a display rack, and comprises a tray and a housing. The tray is a box-like member having a base wall, a side wall extending about the periphery of the base wall, an open top and a hollow interior defined between the base wall and the side wall and in communication with the open top. The hollow interior of the tray is arranged for receipt of the article therein. The housing has a base wall, a side wall extending about a portion of the periphery of the base wall of the housing, an open top and a hollow interior defined between the base wall of the housing and the side wall of the housing and in communication with the open top of the housing. The side wall of the housing has a gap therein in communication with the hollow interior and the open top of the housing. The tray is arranged to be located within the hollow interior of the housing, with the side wall of the tray being located adjacent the side wall of the housing and with the open top of the tray being located within the open top of the housing so that the article is visible therethrough. The tray can be slid out of the housing through the gap. A magnetic closure assembly is provided in the package for releasably holding the tray within the hollow interior of the housing. The housing is adapted to be reversibly disposable with respect to the tray to form a lid for the tray, with the tray located within the hollow interior of the housing and with the base wall of the housing closing the open top of the tray, whereupon the hollow interior of the tray is totally enclosed.

While the convertible package of our aforementioned patent application is suitable for the purpose of serving as a personal item caddy or valet box, it is not conducive for holding and displaying one item for sale, such as a wallet/billfold and another item, such as a gift item or premium that may enhance the saleability of the one. The subject invention addresses that need.

BRIEF SUMMARY OF THE INVENTION

A convertible package comprising the combination of a display box, an article to be merchandised or old, e.g., a wallet or billfold, and an incentive or "gift" article, e.g., a premium such as a multi-function key chain tool, a tool kit, a measuring tape and associated tools, a pop-up book light, etc. The display box comprises a pair of hollow housing sections, each of which includes a base wall and a sidewall extending about the periphery of the base wall to provide a hollow tray for receipt of a respective one of said articles to hold the articles therein against accidental displacement. The housing sections are pivotably connected together by a hinge located at respective portions of the side wall of each housing section, whereupon the peripheral sidewalls of both housing section can be brought into engagement to form an enclosed box in which said articles are located. The housing sections include magnetically securable means that are arranged to be magnetically releasably secured together to hold the box in its closed state, but enabling the housing sections to be separated and pivoted about said hinge so that the articles located within their respective trays are visible for viewing. At least one of the housing sections includes a decorated outer surface to provide the appearance of a wrapped gift box. The package is convertible into a keepsake box by removing the articles from their respective trays.

In accordance with one exemplary aspect of this invention the incentive article is held in place in the tray of its associated housing section by a transparent cover member. The transparent cover member includes a peripheral sidewall and is arranged to be held by frictional engagement within the hollow tray of the associated housing section, by the frictional engagement being between the sidewall of the cover and contiguous portions of the sidewall of the associated housing section.

In accordance with another exemplary aspect of this invention the article to be sold is held within a vending box, e.g., a theft-deterrent box. The vending box has a peripheral sidewall. The vending box with the article to be sold therein is arranged to be held by frictional engagement within the hollow tray of the associated housing section.

BRIEF DESCRIPTION OF SEVERAL VIEWS OF THE DRAWINGS

The invention will be described in conjunction with the following drawings in which like reference numerals designate like elements and wherein.

DETAILED DESCRIPTION OF THE INVENTION

Figure 2:
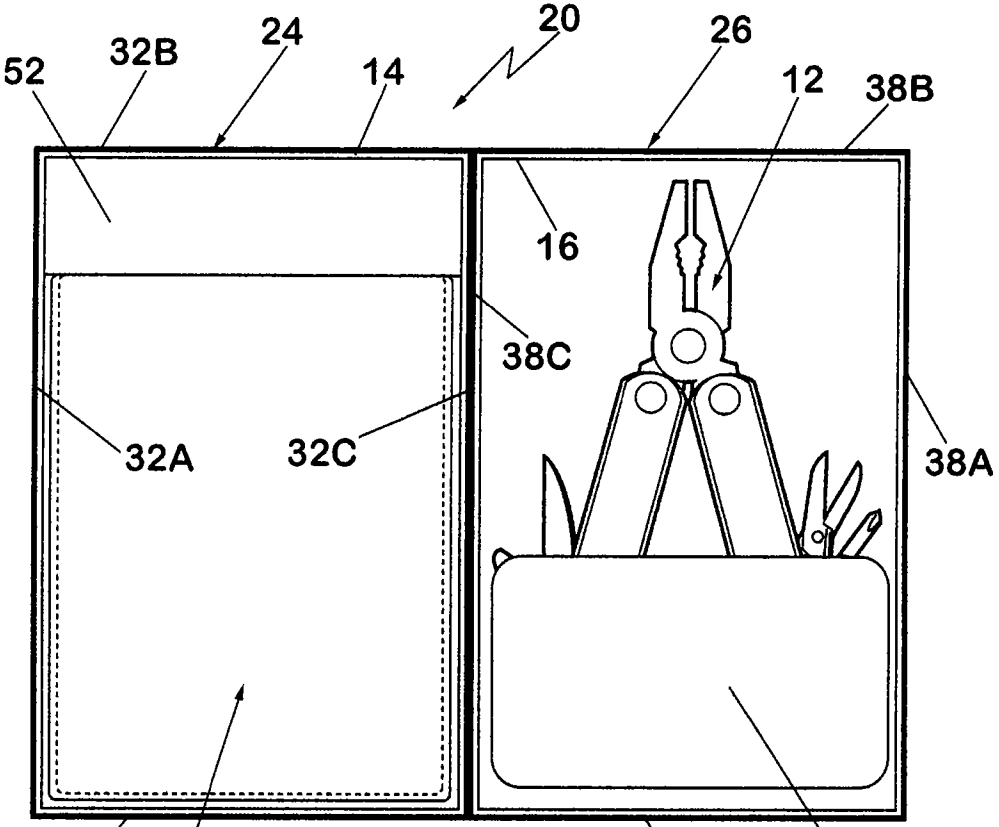
FIG. 2 is a top plan view of the package of FIG. 1, but shown in its open position displaying an article to be sold, e.g., a wallet or billfold, in one section and an incentive or "gift" item, e.g., a multifunction key chain tool, in the other section.
Figure 1:
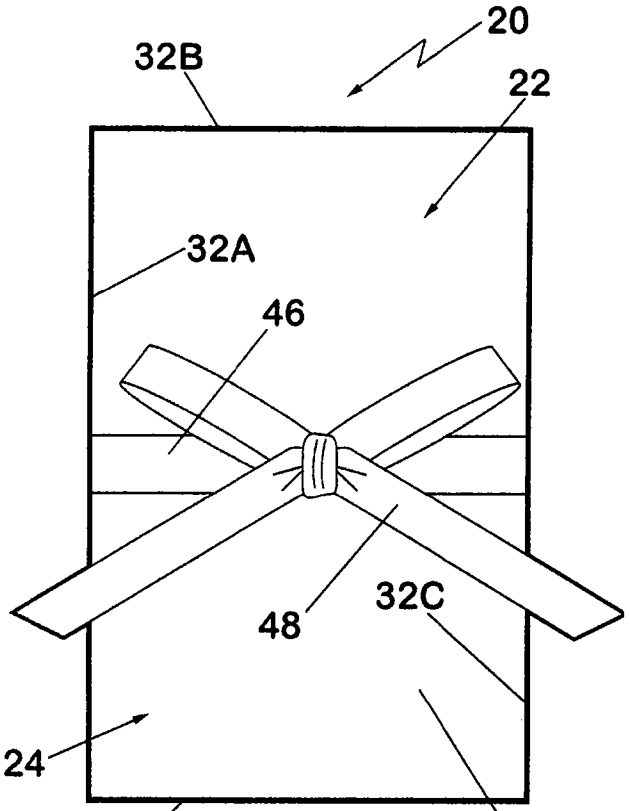
FIG. 1 is a top plan view of one exemplary embodiment of a convertible package of the subject invention shown in its closed condition, wherein the package simulates a gift wrapped present.
Figure 6:
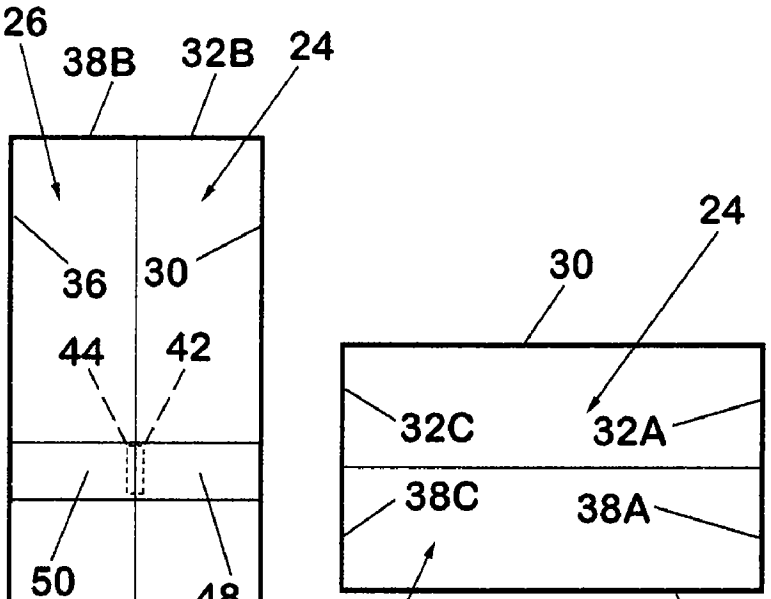
FIG. 6 is a slightly reduced end view of the package shown in FIG. 1.

Referring now in greater detail to the various figures of the drawing, wherein like reference characters refer to like parts, one exemplary convertible package 20 constructed in accordance with this invention. The package 20 is initially configured as a display box to display an item for sale, e.g., a wallet or billfold 10 so that it can be seen and examined by potential purchasers, and another item, e.g., a premium item, such as a multifunction key-chain tool 12, a pop-up book light, etc., which serves as an incentive to purchasers to purchase the item. After purchase of the package, it can be readily converted to serve as a keepsake box or caddy for small personal items, by merely removing its contents. Moreover, the box includes magnetic means for enable the box to be held in a closed state, when desired, but can nevertheless be readily opened.

Figure 5:
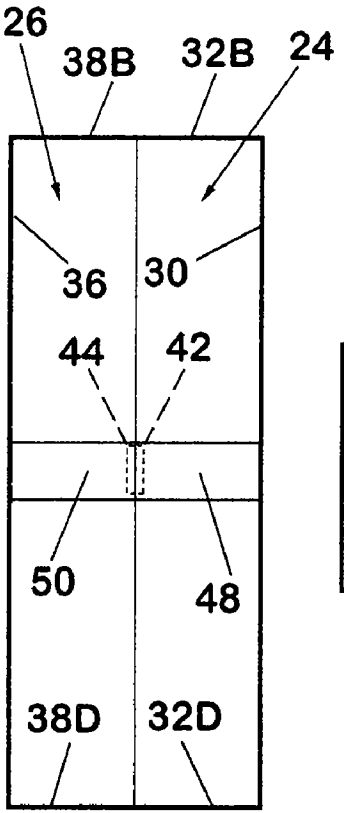
FIG. 5 is a slightly reduced right side view of the package shown in FIG. 1.
Figure 4:
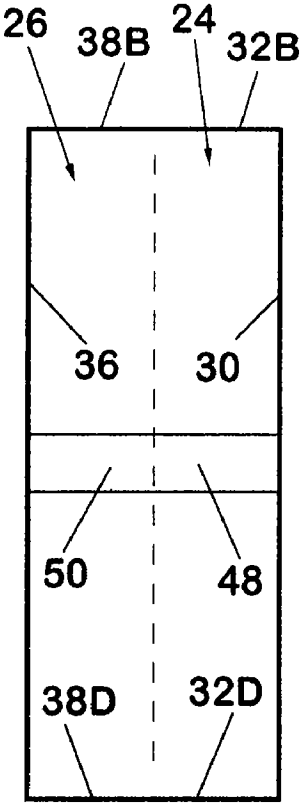
FIG. 4 is a slightly reduced left side view of the package shown in FIG. 1.
Figure 3:
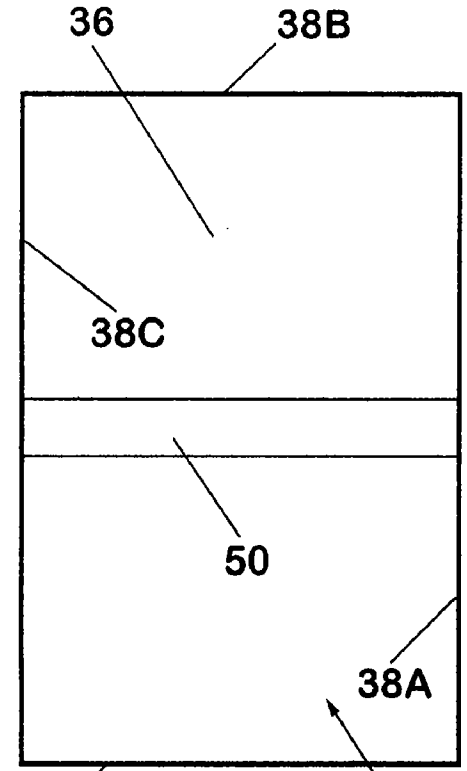
FIG. 3 is a slightly reduced size bottom plan view of the package shown in FIG. 1.
Figures 7, 8, 9:
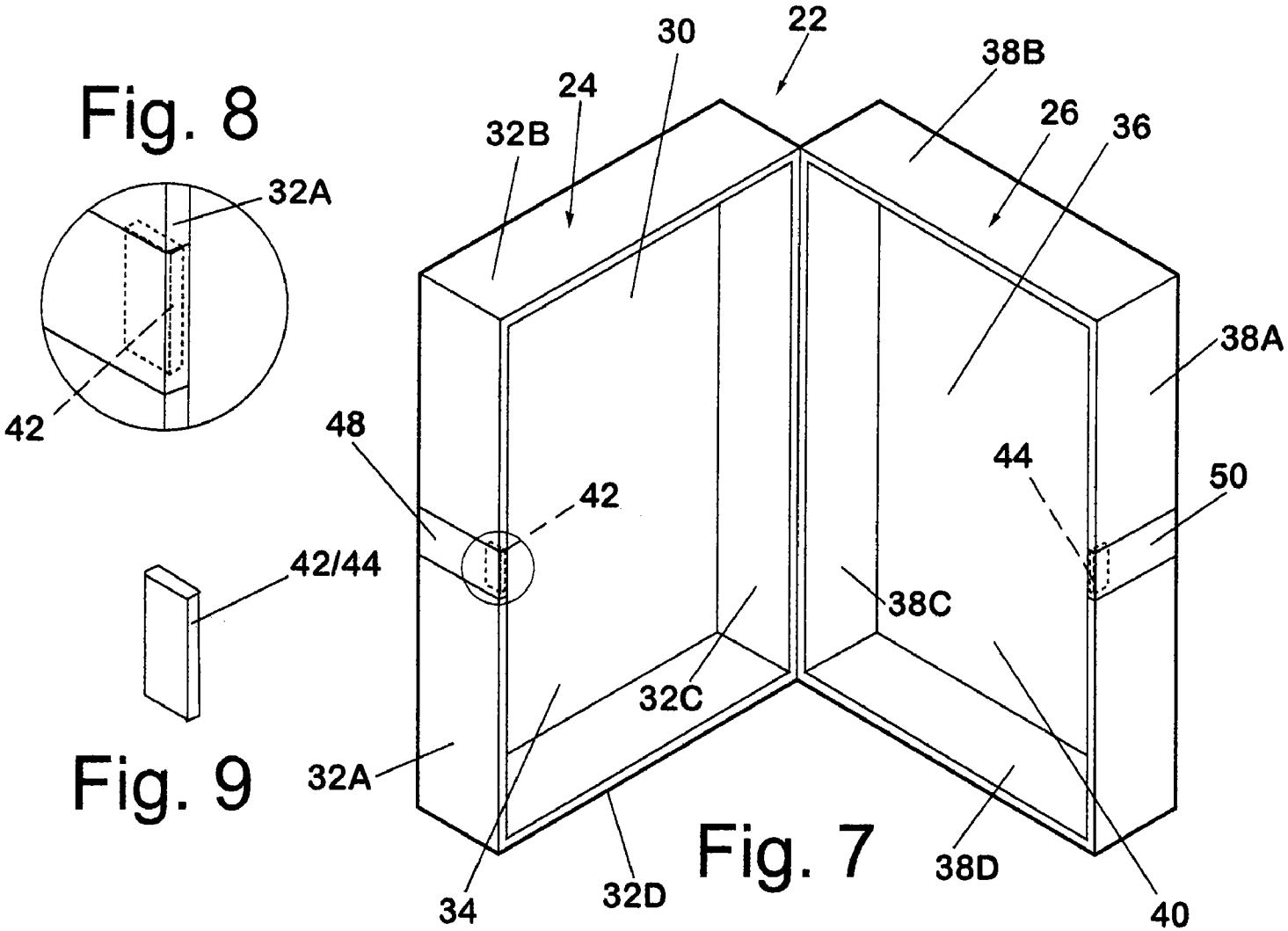
FIG. 7 is an isometric view of a box portion of the package of FIG. 1, but shown in its empty condition.
FIG. 8 is an enlarged isometric view of the portion of the box shown in FIG. 7.
FIG. 9 is an enlarged isometric view of a magnet used in the box shown in FIGS. 7 and 8.

The package 20 basically comprises a display box 22, the wallet or billfold 10 and the premium or gift item 12. The details of the display box will be described later. Suffice it for now to state that it is in the form of two hollow housing sections 24 and 26, each of which is a hollow member forming a tray into which respective ones of the items 10 and 12 are located and held for display. To facilitate display of the contents of the package 20 the housing sections 24 and 26 are pivotally connected together by at least one hinge to enable the display box to be opened, such as shown in FIG. 2, wherein the items can be readily seen and examined by potential customers. The two sections of the box can also be pivoted together to close the box, such as shown in FIGS. 4 and 5.

Figure 11:
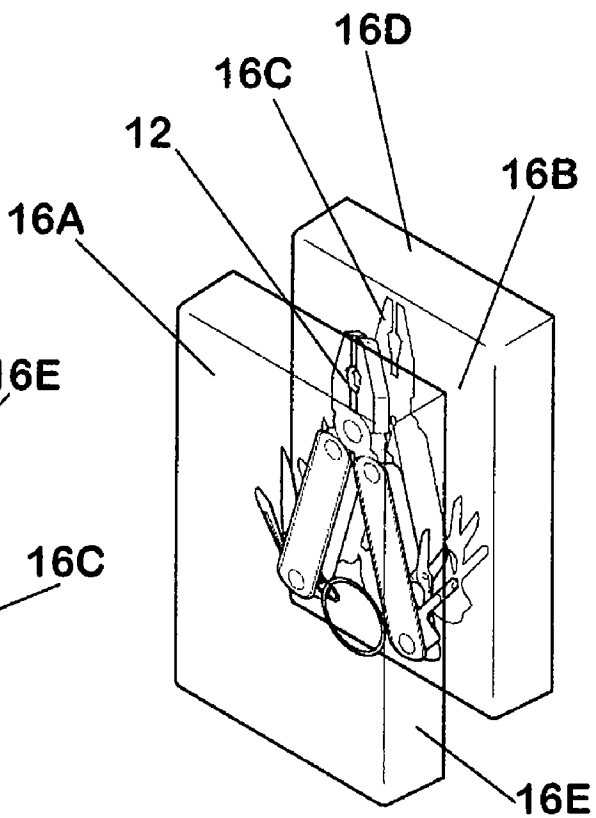
FIG. 11 is an exploded isometric view of one of the components shown in FIG. 10.
Figure 10:
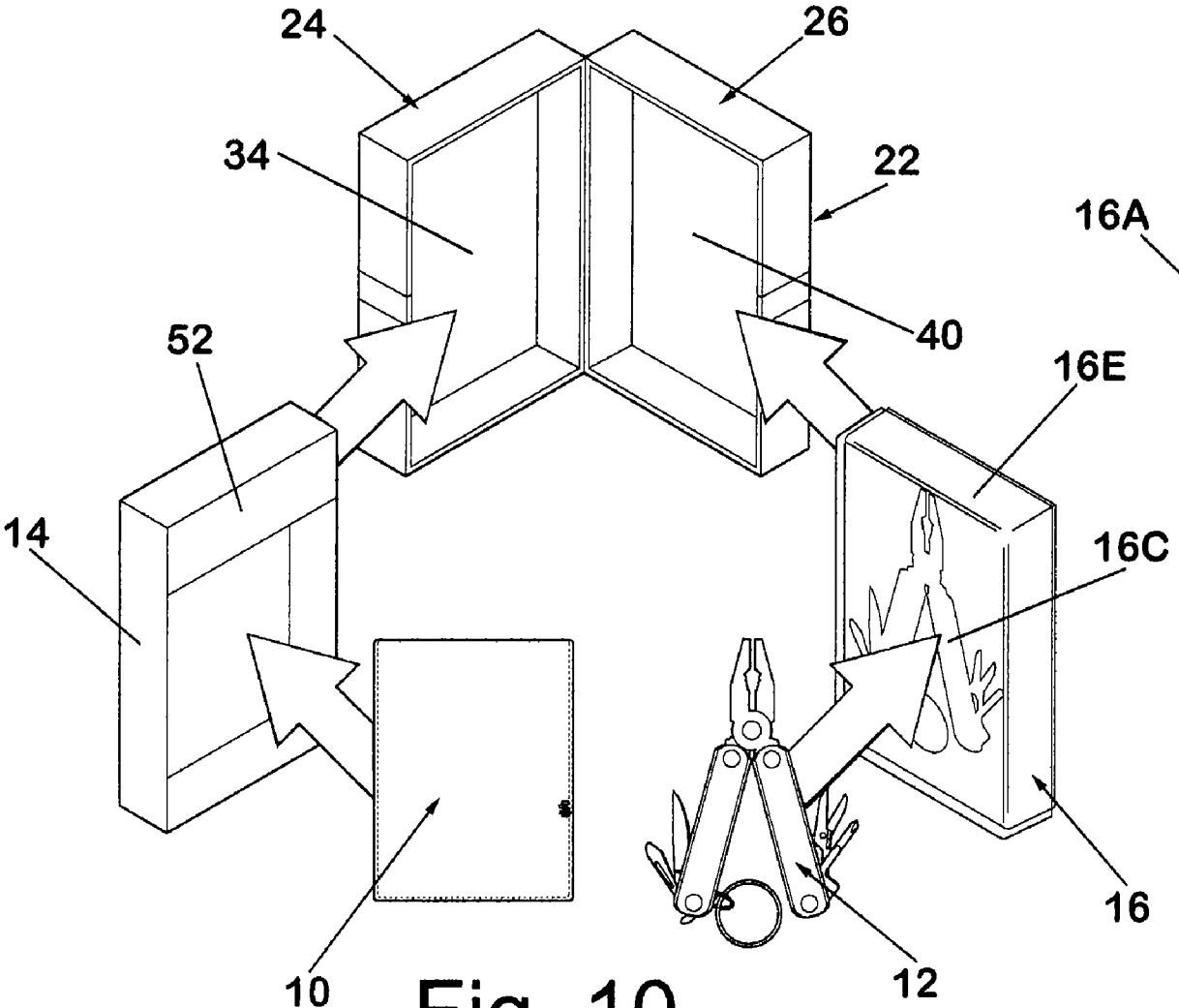
FIG. 10 is an exploded isometric view showing the assembly of the components making up the package of FIG. 1.

In accordance with one preferred embodiment of this invention the wallet/billfold 10 is itself held within an inner or product box 14 (FIGS. 2 and 10). The inner box 14 is a theft deterrent box that is constructed in accordance with the teachings of the aforementioned U.S. Pat. No. 6,053,326 (Ford), e.g., the box 14 includes a band member (not shown) formed of a tear resistant material, e.g., a flat strip of plastic, which extends through a portion of the wallet and is secured to the box 14. In accordance with the aforementioned preferred embodiment of this invention, and as best seen in FIG. 11, the premium item 12 is held within a holder 16 comprising a cover member 16A and a base member 16B. The base member 16B is a planar member that includes a recess 16C shaped to accommodate the premium item 12. A flanged sidewall 16D extends about the periphery of the base member 16B. The holder 16 is preferably formed of a material so that its cover member 16A is transparent to enable potential purchasers to readily view the premium item through the cover. The base member 16B is preferably formed of a thermoformable plastic, but can be formed of other materials as well, and can be the same transparent material as that making up the cover member. The cover member 16A is a generally planar member having a flanged sidewall 16E extending about its periphery. The holder is arranged to hold the premium item securely therein by placing the item 12 within the recess 16C and then the cover member placed over the base member, such as shown in FIG. 11, so that the flanged sidewall of the cover member frictionally engages the flanged sidewall of the base member. Once in this state the premium item held within the hold is ready to be inserted into one of the hollow sections 24 or 26 of the display box as shown in FIG. 10. In the embodiment shown in FIG. 10, the premium item 12 with its hold 16 is inserted into the hollow section 26 of the display box. The item to be sold, e.g., the wallet/billfold 10 that is itself disposed within the theft-deterrent box 14 can be inserted into the other hollow section 24 of the display box 20. It should be pointed out at this juncture that the above arrangement is merely exemplary, since the item 10 can be disposed in the hollow section 26, and the premium item disposed in hollow section 24, if desired.

Irrespective of which section 24 or 26 of the display box the items 10 and 12 are to be held in, it is preferred that those items be held in a condition wherein accidental displacement from their resident sections is precluded or at least minimized. To that end the peripheral sidewall of the theft deterrent box 14 holding the wallet/billfold is arranged to frictionally engage a portion of the housing section 24. In a similar manner the peripheral sidewall of the holder 16 holding the premium item 12 is arranged to frictionally engage a portion of the housing section 26.

Turning now to FIGS. 1 and 3-7, the details of the display box 20 will now be described. To that end, as discussed earlier, the box 20 includes the two pivotably connected housing sections 24 and 26. Each section 24 and 26 is of similar tray like shape and are preferably formed of any relatively inexpensive, rigid material, e.g., paperboard, plastic, wood, metal or combinations thereof, with the type of material used being a function of the desired cost for producing the package. For low cost applications the tray and housing may be formed of paperboard or similar low cost materials and having a film or other covering thereon which bears graphics and/or textures to simulate higher cost materials, e.g., a fine wood or metal.

Section 24 comprises a parallelepiped shaped body having a generally planar base-wall 30 having a peripheral sidewall including a outer side section 32A, a top section 32B, an inner side section 32C and a bottom section 32D, thereby defining a hollow interior 34. In a similar manner, section 26 comprises a parallelepiped shaped body having a generally planar base-wall 36 having a peripheral sidewall including a outer side section 38A, a top section 38B, an inner side section 38C and a bottom section 38D, thereby defining a hollow interior 40. The inner side sections 32C and 38C are pivotably connected together by means of at least one hinge (not shown). The hinge can be formed of any suitable member. In one exemplary preferred embodiment the hinge is formed by a covering or layer of a flexible material, e.g., mylar, decorated plastic film, foil or laminates of any of the foregoing. The covering is secured to the outer surface of the side sections 32C and 38C and bridges those side sections. In fact, it is contemplated that the covering or layer can be a decorative covering that is secured over and covers the entire exterior surface of the sections 24 and 26 to provide the box 20 with appearance of a gift wrapped package.

The disposition of the theft-deterrent inner box 14 with the wallet/billfold 10 therein in the hollow interior 34 of the housing section 24 and the disposition of the holder 16 with the gift item 12 therein in the hollow interior 40 of the housing section 26 will now be described with reference to FIG. 10. To that end the box 14 with its wallet/billfold 10 is inserted into the hollow interior 34 of the housing section 24 so that the peripheral surface of the box 14 frictionally engages the interior surface of the sidewall sections 32A-32D. In a similar manner, the holder 16 with its premium item 12 is inserted into the hollow interior 40 of the housing section 26 so that the peripheral surface of the holder 16 frictionally engages the interior surface of the sidewall sections 38A-38D. Once the items 10 and 12 are located in the display box 20, the package 20 is completed and can be displayed in the retail environment by opening the box so that the wallet/billfold 10 and the premium item 12 is readily visible to potential customers.

In order to enable the display package 20 to be held in a closed condition, when such is desired, the display box 22 includes magnetic securement means. Such means can take various forms. In the exemplary embodiments shown herein, and in particular in FIGS. 7-9, it is made up of two magnets 42 and 44. These magnets are located within respective corresponding shaped recesses in the outer side sections 32A and 38A, respectively, of housing sections 24 and 26, respectively. The magnets 42 and 44 are located so that they confront each other when the two housing sections are pivoted to the closed condition, whereupon the magnetic attraction of the magnets 42 and 44 holds the two sections 24 and 26 together. It should be appreciated by those skilled in the art two magnets 42 and 44 need not be used. Thus, it is contemplated that only one magnet 42 or 44 be used, with the other cooperating component (which would have been a magnet) merely being a slug of some material which is attracted to a magnet, that slug of material is located in a recess directly confronting the magnet 42 or 44 when the box is closed.

As mentioned earlier, the display box 20 may include a cover layer to provide a decorative, gift-like package appearance. It should be noted that the provision of such an appearance is not dependent upon the use of a decorative cover layer over the entire box or any part of it. Thus, the material making up the two housing sections 24 and 26 can itself provide a decorative appearance. For example, if the box is formed of wood, its outer surface may be finished to provide a rich look, which would be particularly effective for vending relatively expensive wallets/billfolds.

In the exemplary embodiment discussed above, in order to enhance the gift-like appearance of the package 20, the outer surface of the housing section 24 includes a bow 46 and an associated ribbon 48. A similar ribbon 50 is preferably located on the outer surface of the housing section 26, so that when the display box is in its closed condition it provides the appearance of a gift package that has been wrapped by a ribbon terminating in a bow. Other decorative features may be provided on the outer surface of the display box, if desired, depending upon the application.

The theft-deterrent box 14 holding the wallet/billfold 10 may include a panel 52 (FIGS. 2 and 10) on which printed indicia, e.g., material describing the wallet/billfold, may be disposed. Similarly, the holder 16 may include an opaque sticker 54 on which printed indicia, e.g., display information, may be located.

After the package 20 with the wallet/billfold 10 and premium item 12 therein has been purchased and brought home by the buyer, the wallet/billfold 10 and the premium item 12 can be readily removed for use. Unlike the wallet-holding boxes of the prior art as discussed above, which after the wallet has been removed are discarded, the package 20 of this invention is suitable for continued, albeit other, usage. In particular, after serving as the vending box for the wallet and the premium item, the package 20 can be converted to be used as a valet, caddy or case for small personal items, e.g., jewelry, etc. In fact, if desired, it can still be used to hold the wallet when the wallet is not being used by the purchaser.

By virtue of its ability for dual usage, the convertible package of this invention can serve as a further gift or premium to the purchaser of the wallet, above that provided by the gift item 12 by offering that purchaser additional value for his/her purchase of the wallet. Moreover, as will be appreciated the package 20 of this invention offers significant advantages to the manufacturer/retailer since it can be made for a small incremental cost over the cost of a disposable package, like the prior art, yet still provide an aesthetically pleasing and "rich-looking" appearance, thereby enhancing the prospect of selling the wallet.

It should be pointed out at this juncture that the shape, size and construction of the display box as shown and described above is merely exemplary of numerous shapes and sizes of packages that can be made in accordance with this invention. Moreover, while the package has been shown and described for merchandising a wallet or billfold, that is merely one example of various products that can be merchandised using such packages. Further still, the packages of this invention may be used with some means, e.g., a hanger (not shown) to suspend it from a display rack. However, packages of this invention need not be used with any device for hanging it. Thus, they can be used by merely disposing them on some support surface, e.g., on a shelf of a rack or counter, etc.

While the invention has been described in detail and with reference to specific examples thereof, it will be apparent to one skilled in the art that various changes and modifications can be made therein without departing from the spirit and scope thereof.

What is claimed is:

1. A convertible display package comprising the combination of a display box, a vending box, an item to be sold and a premium item, said display box comprising a pair of hollow housing sections, each of said housing sections including a base wall and a sidewall extending about the periphery of said base wall and flush with said base wall to provide a hollow tray of parallelepiped shape for receipt of a respective one of said items therein to hold said items therein against accidental displacement, said housing sections being pivotably connected together by a hinge located at respective portions of said sidewalls of said housing sections to enable respective sidewalls of said housing sections to be brought into engagement to form an enclosed box of parallelepiped shape having flush sidewalls, said hinge being arranged so that it doesn't project beyond the plane of said respective sidewall portions, said housing sections including at least one recessed magnet for magnetically releasably securing said housing sections together, but enabling said housing sections to be separated and pivoted about said hinge so that said items located within their respective trays are visible for viewing, at least one of said housing sections including a decorated outer surface to provide said display box with the appearance of a wrapped gift box when said housing sections are magnetically secured together, said item to be sold being located within said vending box, said vending box having a peripheral sidewall releasably secured by frictional engagement within said hollow tray of one of said housing sections to enable said vending box to be removed therefrom, said package being convertible into a keepsake box by removing said items from their respective trays.

2. The convertible display package of claim 1 wherein said magnetically securable means comprise at least one magnet.

3. The convertible display package of claim 2 wherein said magnetically securable means comprises a pair of magnets, each of said pair of magnets being mounted within a respective recess in a respective sidewall of an associated housing section.

4. The convertible display package of claim 1 wherein said premium item is held in place in said tray of an associated housing section by a transparent cover member.

5. The convertible display package of claim 4 wherein said transparent cover member includes a peripheral sidewall and wherein said cover member is arranged to be held by frictional engagement within said hollow tray of said associated housing section, with the frictional engagement being between said sidewall of said cover member and contignous portions of said sidewall of said associated housing section.

6. The convertible display package of claim 1 wherein said premium item is held in place in said tray of an associated housing section by a transparent cover member.

7. The convertible display package of claim 6 wherein said transparent cover member includes a peripheral sidewall and wherein said cover member is arranged to be held by frictional engagement within said tray of said associated housing section, with said frictional engagement being between said sidewall of said cover and contiguous portions of said sidewall of said associated housing section.

8. The convertible display package of claim 7 wherein said item to be sold comprises a wallet or billfold.

9. The convertible display package of claim 8 wherein said vending box is a theft-deterrent box.

* * * * *

UNITED STATES PATENT AND TRADEMARK OFFICE

CERTIFICATE OF CORRECTION

PATENT NO. : 7,641,051 B2
APPLICATION NO. : 11/531128
DATED : January 5, 2010
INVENTOR(S) : Ford et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 601 days.

Signed and Sealed this

Sixteenth Day of November, 2010

David J. Kappos

David J. Kappos
*Director of the United States Patent and Trademark Office*